US005191749A

United States Patent [19]

Cappi et al.

[11] Patent Number: 5,191,749

[45] Date of Patent: Mar. 9, 1993

[54] PLASTIC BAG DISPENSING APPARATUS FOR SUPERMARKETS INCORPORATING DEVICES FOR THE REGISTERING OF THE PURCHASED ITEMS

[75] Inventors: Angelo Cappi, Modena; Renato Rimondi, Bologna, both of Italy

[73] Assignee: A.W.A.X. Progettazione E Ricerca S.R.L., Modena, Italy

[21] Appl. No.: 782,140

[22] Filed: Oct. 25, 1991

[30] Foreign Application Priority Data

Nov. 2, 1990 [IT] Italy ..... 21957 A/90

[51] Int. Cl.[5] ..... B65B 67/04; B65B 5/02; B65B 5/08

[52] U.S. Cl. ..... 53/502; 53/75; 53/77; 53/567; 53/390

[58] Field of Search ..... 53/567, 77, 502, 52, 53/570, 75, 390

[56] References Cited

U.S. PATENT DOCUMENTS

| | | | |
|---|---|---|---|
| 3,792,565 | 2/1974 | Goransson | 53/567 |
| 3,859,062 | 1/1975 | Okubo et al. | 53/567 |
| 3,977,483 | 8/1976 | Greanias | 53/502 X |
| 4,030,270 | 6/1977 | Arnold | 53/567 |
| 4,676,343 | 6/1987 | Humble et al. . | |
| 4,792,018 | 12/1988 | Humble et al. . | |
| 4,909,356 | 3/1990 | Rimondi et al. | 53/502 X |

FOREIGN PATENT DOCUMENTS

| | | |
|---|---|---|
| 0327514 | 8/1989 | European Pat. Off. . |
| 429416 | 5/1991 | European Pat. Off. . |
| 2161631 | 1/1986 | United Kingdom . |

*Primary Examiner*—Horace M. Culver

*Attorney, Agent, or Firm*—Cohen, Pontani, Lieberman, Pavane

[57] ABSTRACT

Apparatus for self-service scanning, registering and bagging a product purchased in a supermarket. The apparatus comprises a unit (1) for dispensing and opening a single plastic bag from a continuous strip wound in a reel, a balance (2) for weighing the item to be purchased, a reel supporting device (3) which feeds the strip of bags to the dispensing and opening unit (1), and a unit comprising a scanner (6) and a computer (7).

5 Claims, 3 Drawing Sheets

PLASTIC BAG DISPENSING APPARATUS FOR SUPERMARKETS INCORPORATING DEVICES FOR THE REGISTERING OF THE PURCHASED ITEMS

BACKGROUND OF THE INVENTION

The present invention relates to an apparatus intended to be placed in supermarkets and in other similar points of sale to dispense one at a time plastic bags unwound from a reel, open them and keep them open below a mouth through which the customer of the supermarket may insert in the bag the purchased items that must be taken away, after having registered their characteristics and cost by means of a scanner connected to such apparatus by a computer.

It is known that recently in supermarkets, and in other similar points of sale, devices have been introduced to dispense plastic bags to the customers and allow them to easily insert in such bags, kept open by the device, the purchased items normally paid to the check-out counter. Devices of this kind are described for instance in the U.S. patent application Ser. No. 07/613234 filed by the same applicatant.

Such prior devices have no instrument to verify the characteristics and price of the purchased items so their use is solely limited to the packaging of the purchased goods. Thus they may be used only downstream the check-out counters of the supermarkets and therefore they do not contribute to reduce the time that cashiers need to register the goods purchased by each customer.

SUMMARY OF THE INVENTION

The object of the present invention is to provide a bag dispensing apparatus suitable to be used upstream of the check-out counters of the supermarkets to allow the customer to register by himself the purchased goods and come to the check-out counter only to pay the due amount.

Such object is achieved according to the present invention by means of a bag dispensing apparatus of the type described in the above mentioned patent application characterized in that it comprises as well a scanner connected through a computer to a balance arranged below said dispensing device and suitable to detect the weight of the items inserted into the plastic bags.

In addition to packaging the purchased items, the dispensing apparatus according to the present invention offers the advantage of providing the customer a precise registration of such items and therefore requiring the customer to stay at the check-out counter exclusively for the time necessary for the payment of the bill. Obviously this considerably limits the forming of queues at the check-out counters.

A further advantage offered by the dispenser according to this invention consists in that it can be directly connected by means of cables to the check-out counter therefore with no need even of the use of a printer to issue cash-slips.

BRIEF DESCRIPTION OF THE DRAWINGS

These and other advantages and characteristics of the apparatus according to the present invention will be clear to those skilled in the art from the following detailed description of one embodiment thereof with reference to the annexed drawings in which.

DESCRIPTION OF THE PRESENTLY PREFERRED EMBODIMENT

Figure 1:
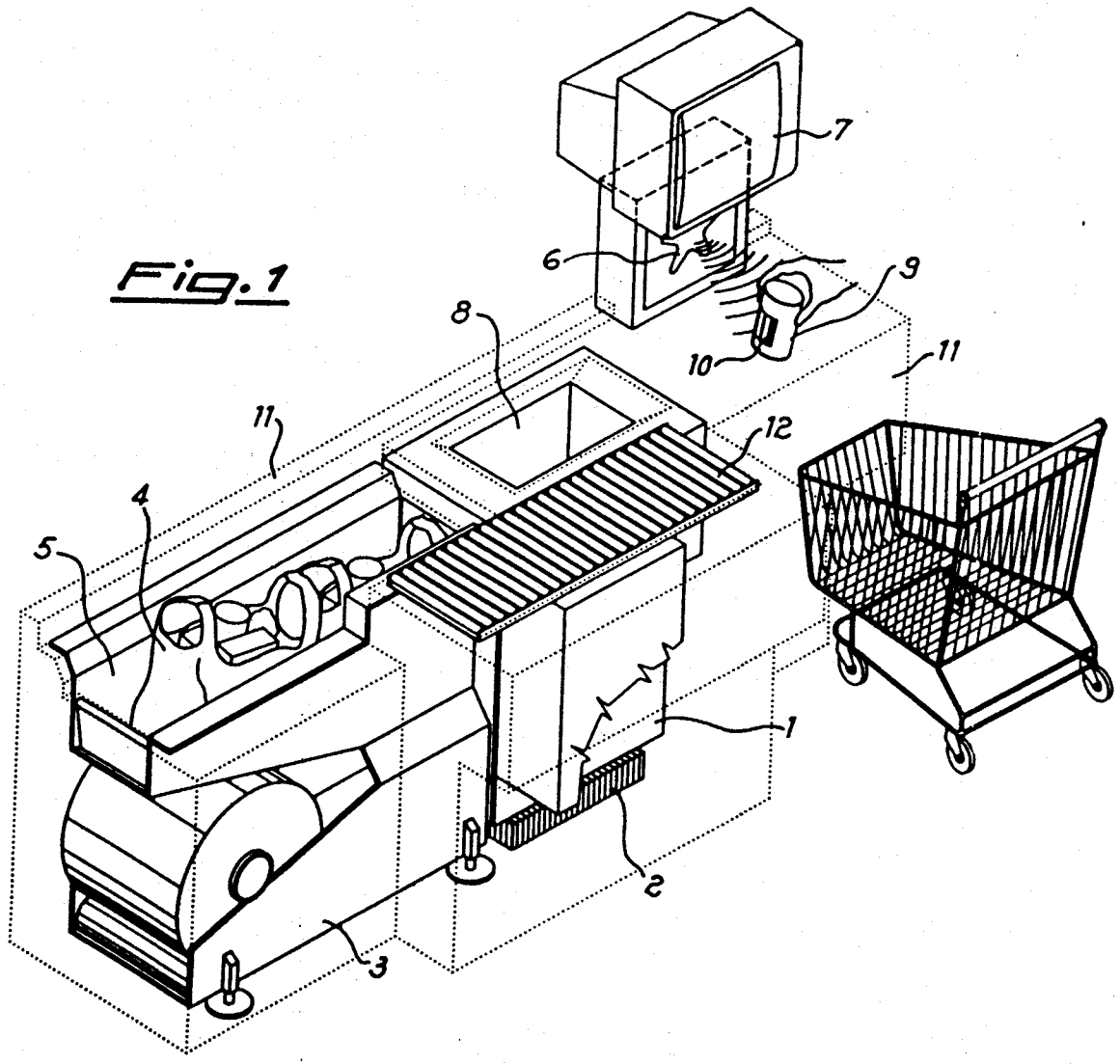
FIG. 1 shows a perspective view of a dispensing apparatus according to the present invention.

Referring to FIG. 1 there can be seen that the apparatus according to the present invention comprises four distinct functional assemblable blocks or units, i.e. a unit 1 for dispensing and opening the bags that rests on a balance 2 and that is interposed between a reel supporting device 3, surmounted by a channel 5 for the removal of bags 4, and a counter 11 on which a scanner 6 and a computer 7 are mounted. Unit 1 has on its upper part a mouth 8 through which the customer may insert the purchased items and let them fall inside a bag 4 arranged in open position below said mouth 8.

In FIG. 1, a customer's hand is shown holding a can 9 taken from an usual supermarket cart and, is causing the scanner 6 to read the bar code 10 imprinted on said can 9. The scanner decodes all data contained in the bar code, among which the weight of can 9 with the allowable deviation in weight thereof. Such data are stored inside computer 7 as a projected weight and displayed on the monitor, while scanner 6 is inhibited. Because of such inhibition the customer erroneously register the can 9 more than once, or register a further item forgetting to insert the can 9 into the bag 4. If the bar code imprinted on the can or other packaging of a product does not contain weight information, such weight information may be entered into the computer by a store employee in the manner similar to that used for entering pricing information.

The can 9 is introduced by the customer into the mouth 8 and dropped into the underposed bag 4. Now the balance 2, whose tare comprises the weight of the whole unit 1, detects the actual weight of can 9 and transmits it to the computer. The computer compares the actual weight of can 9 detected by the balance 2 and the projected weight read or determined from the bar code, taking into account the allowable deviation as well. If the two values of the can weight agree, the computer reactivates the scanner 6 allowing the registration of another item.

In the case in which the two weights, detected respectively by balance 2 and by scanner 6, of the same item differ, an order appears on the monitor to remove the can 9 from bag 4 and to repeat the registrations thereof by scanner 6 which is reactivated in the meantime. If after said second registration a difference still exists between the weight read in the bar code 10 and the one detected by the balance, the request will appear on the monitor of computer 7 to seek for the technical assistance of supermarket personnel to repair the obvious breakdown.

The customer may go on with the registration of the items he purchased until the last one of them or until bag 4 is completely filled. In the first case the customer presses a suitable button causing the ejection of the filled bag 4 which is pushed on the channel 5 from which it can be easily taken by the customer before going to the check-out counter for the payment of the purchased goods.

In the second case, the customer reads on the monitor of computer 7 the order to pull out from the mouth 8 the last item inserted since it will overfill bag 4. Once the customer has executed this extraction following the instructions read on the monitor of computer 7, this monitor displays the request for the customer to press the button for which ejects the filled bag 4 and dispenses an empty bag 4' below the mouth 8. In the meantime the scanner 6 has been reactivated so the customer may register a new item taken from the trolley and begin a new operating cycle until the complete packaging of all the items he purchased or to the complete filling of the new bag with consequent need of dispensing a further bag.

For the bulky items that cannot pass through the mouth 8 and therefore cannot even be inserted into the plastic bags, a roller path is provided, on which the items already registered by scanner 6 may be weighted. In fact such roller path is integral with unit 1 so it loads as well balance 2. As soon as the bulky item placed on the roller path 12 has been weighed, the reactivation takes place of scanner 6 that, as in the other cases, had been inhibited after the registration of the bulky item.

Figure 2:
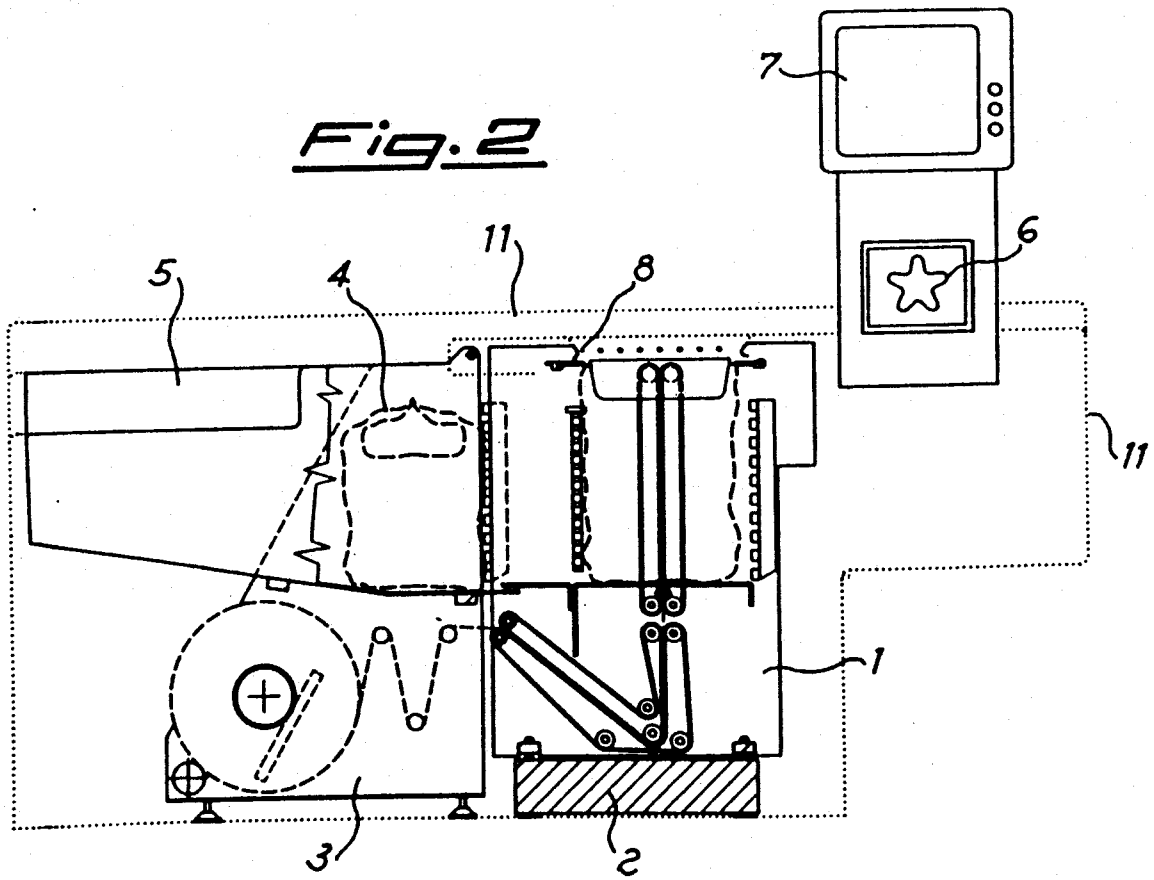
FIG. 2 shows an elevational partially sctioned front view of the apparatus according to the present invention.

Referring to FIG. 2 there can be seen how the reel supporting device 3 as well as unit 1 are mounted on the sides of counter 11, both of them being of the type described in the U.S. patent application Ser. No. 07/613234 of the same applicant. Only unit 1 and roller path 12 exert a load to balance 2 which therefore can detect their weight as a tare and therefore actual weight of each item inserted into the apparatus through the mount 8 can be determined. To this end it is important that unit 1 is completely divided from the reel supporting device 3 as the weight thereof changes continuously during the consumption of the reel.

The balance 2 may be suitably chosen among those known on sale having a limiting height so that the mouth 8 is always easily accessible for the customer. As these are known balances they do not need any particular description, and the same for scanner 6 and computer 7.

Figure 3:
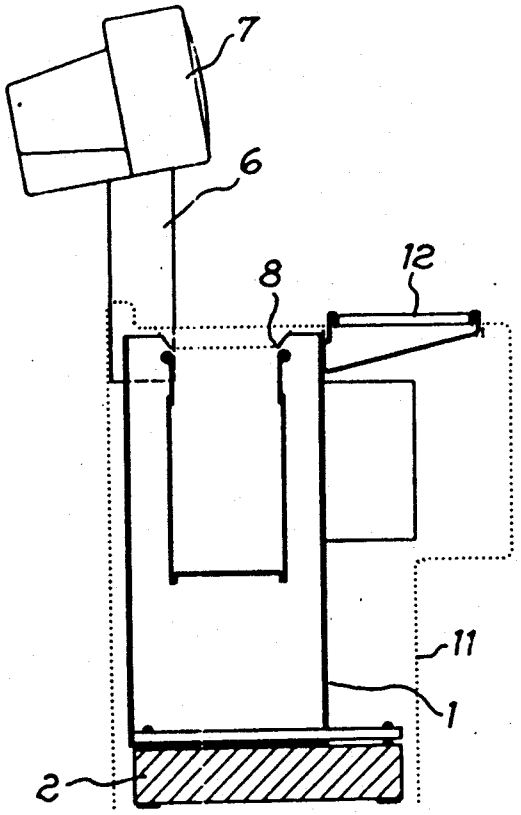
FIG. 3 shows an elevational partially sectioned side view of the dispensing apparatus.

In FIG. 3 there can be seen that the roller path 12 is an integral part of unit 1 so it is detected as well like tare of balance 2.

Figure 4:
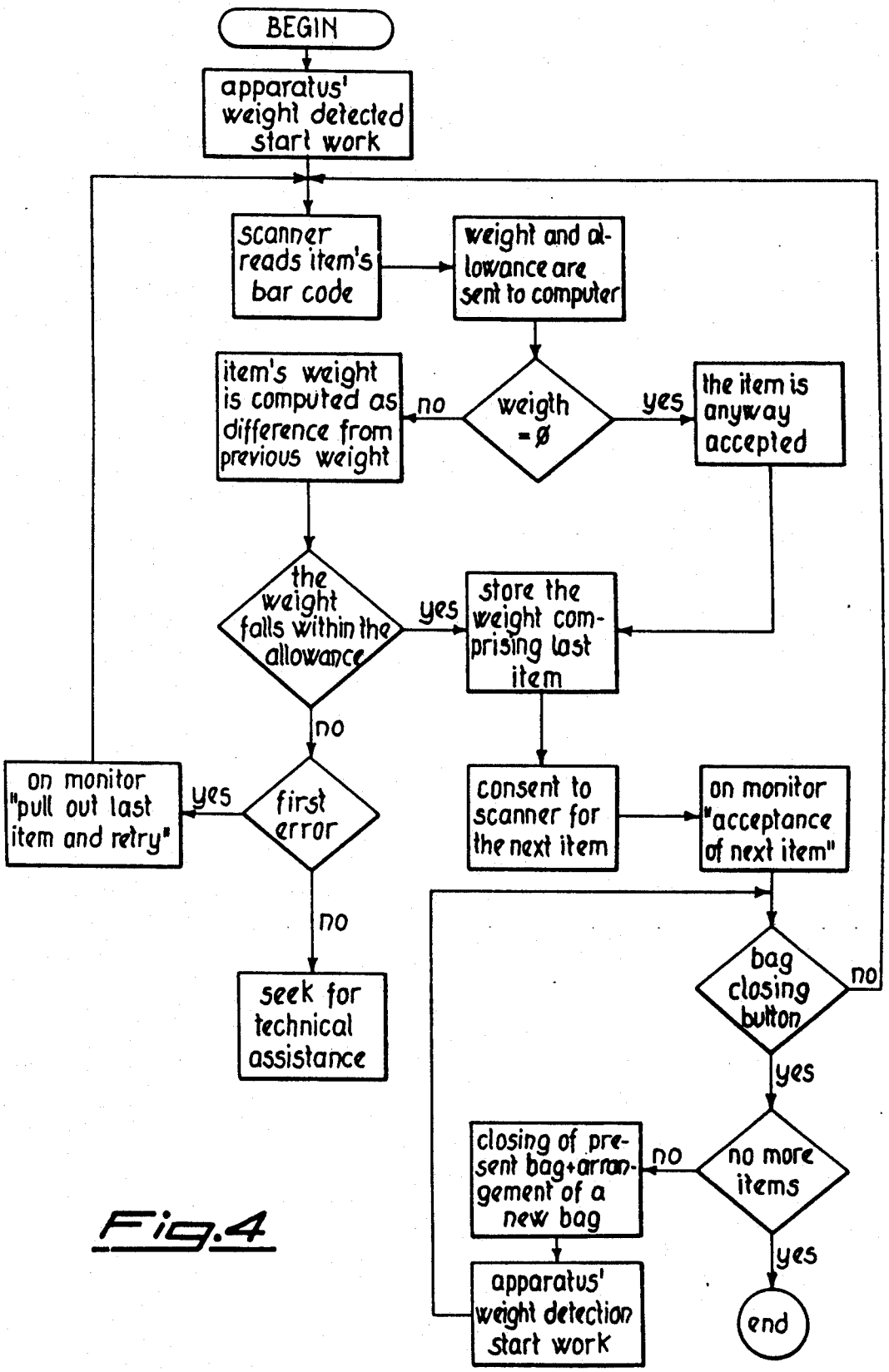
FIG. 4 shows a flow-chart describing the functioning of such apparatus.

In FIG. 4 a flow-chart is shown describing in a clear and simple manner the functioning of the apparatus according to this invention. Not appearing in said flow-chart is the operating step in which the cash-slip is issued that the customer must show at the check-out counter for the payment of the items he purchased and inserted in the plastic bags 4. The printer is not shown in the other drawings as it does not fall within the scope of the present invention. In fact it may be mounted, in a known way, in the apparatus according to the present invention, or it may be eliminated. In this second case the check-out counter would receive by means of cables all data registered by the scanner and displayed by the monitor of computer 7 from which the customer would not only have to note the amount to pay at the check-out counter.

Further variations and/or modifications may be made by those skilled in the art to the apparatus according to the present invention and in particular to its embodiments hereinabove described only as nonlimiting examples of the apparatus itself.

What is claimed is:

1. Apparatus for self-serving scanning, registering and bagging a product purchased in a supermarket, the product having product information concerning the product imprinted on a label on packaging of the product, comprising:

a bag dispensing and opening unit (1) for dispensing and opening a single flexible bag from a continuous web of successively joined, preformed flexible bags;

a reel supporting unit (3) for supporting the continuous web of flexible bags and for feeding the web to said bag dispensing and opening unit (1);

a balance (2) for determining the actual weight of the product and for providing and output indicating the actual weight of the product; and a scanning and computing unit comprising a computer (7) and a scanner (6), said scanner (6) detecting the product information imprinted on the label on the packaging of the product and transmitting the product information to the computer (7) said computer (7) using the product information detected by said scanner (6) to determine a projected weight of the product, said computer (7) receiving the output from the balance (2) indicating actual weight of the product, said computer (7) comparing the actual weight of the product to the projected weight of the product, and said computer (7) providing an output indicating whether the actual weight of the product exeeds a predetermined deviation from the projected weight of the product.

2. The apparatus of claim 1 wherein said scanner (6) is disabled when said computer (7) determines that the actual weight of the product exceeds a predetermined deviation from the projected weight of the product.

3. The apparatus of claim 1 wherein said scanner (6) is disabled after said scanner (6) has detected information imprinted on the label on the packaging of the product and wherein said scanner (6) is enabled after said balance (2) determines the actual weight of the product and after said computer (7) determines that the actual weight of the product is within a predetermined deviation from the projected weight of the product.

4. The apparatus of claim 1 wherein said bag dispensing and opening unit (1), said reel supporting unit (3), said balance (2) and said scanning and computing unit are four assemblable units.

5. The apparatus of claim 1 wherein said balance (2) supports said bag dispensing and opening unit (1).

* * * * *